US009249605B2

(12) United States Patent
Yamagata et al.

(10) Patent No.: US 9,249,605 B2
(45) Date of Patent: Feb. 2, 2016

(54) DOOR LOCK APPARATUS

(75) Inventors: Mikio Yamagata, Hiroshima (JP); Nobuya Akagi, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 873 days.

(21) Appl. No.: 13/451,717

(22) Filed: Apr. 20, 2012

(65) Prior Publication Data

US 2012/0266639 A1 Oct. 25, 2012

(30) Foreign Application Priority Data

Apr. 22, 2011 (JP) ..... 2011-096074

(51) Int. Cl.

| | |
|---|---|
| ***E05B 47/00*** | (2006.01) |
| ***E05B 79/08*** | (2014.01) |
| ***E05B 81/06*** | (2014.01) |
| ***E05B 85/02*** | (2014.01) |
| ***E05B 77/32*** | (2014.01) |
| ***E05B 81/16*** | (2014.01) |
| ***E05B 81/34*** | (2014.01) |
| ***E05B 81/42*** | (2014.01) |

(52) U.S. Cl.

CPC ..... *E05B 79/08* (2013.01); *E05B 77/32* (2013.01); *E05B 81/06* (2013.01); *E05B 81/16* (2013.01); *E05B 81/34* (2013.01); *E05B 81/42* (2013.01); *E05B 85/02* (2013.01); *E05B 2047/002* (2013.01); *E05B 2047/0025* (2013.01); *Y10T 70/7667* (2015.04)

(58) Field of Classification Search

CPC ..... E05B 79/08; E05B 81/16; E05B 81/34; E05B 81/42; E05B 81/06; E05B 77/32; E05B 85/02; E05B 2047/0025; E05B 2047/002; Y10T 70/7667

USPC ..... 70/237, 264, 278.7, 279.1; 292/201, 292/216

See application file for complete search history.

(56) References Cited

U.S. PATENT DOCUMENTS

| | | | | |
|---|---|---|---|---|
| 3,159,994 | A * | 12/1964 | Schulz | 70/484 |
| 3,653,237 | A * | 4/1972 | DuRocher | 70/264 |
| 4,732,418 | A * | 3/1988 | Crown et al. | 292/207 |
| 5,537,848 | A * | 7/1996 | Grzanka et al. | 70/279.1 |
| 6,053,543 | A * | 4/2000 | Arabia et al. | 292/201 |
| 6,067,826 | A * | 5/2000 | Holloway et al. | 70/278.3 |
| 6,145,354 | A * | 11/2000 | Kondo et al. | 70/279.1 |
| 8,151,610 | B2 * | 4/2012 | Fujihara | 70/278.7 |
| 8,403,379 | B2 * | 3/2013 | Ishiguro et al. | 292/201 |
| 2002/0056298 | A1 * | 5/2002 | Fukunaga et al. | 70/237 |
| 2002/0170325 | A1 * | 11/2002 | Choi | 70/264 |
| 2005/0253400 | A1 * | 11/2005 | Harada et al. | 292/201 |
| 2007/0163313 | A1 * | 7/2007 | Zamora | 70/237 |
| 2009/0314045 | A1 * | 12/2009 | Giacomin et al. | 70/237 |

FOREIGN PATENT DOCUMENTS

| | | |
|---|---|---|
| JP | 2005-282221 | 10/2005 |
| JP | 2005-307446 | 11/2005 |
| JP | 2009-150114 | 7/2009 |

* cited by examiner

*Primary Examiner* — Lloyd Gall

(74) *Attorney, Agent, or Firm* — Wenderoth, Lind & Ponack, L.L.P.

(57) ABSTRACT

A door lock apparatus includes: a latch mechanism; a lock mechanism having a link that can move the latch mechanism to an unlock position and a lock position, and a lock plate that moves the link; a key-operation-force transfer mechanism that transfers an operation force of a key cylinder to the lock plate of the lock mechanism; and a housing in which at least the lock mechanism and the key-operation-force transfer mechanism are accommodated. The door lock apparatus further includes a positioning portion and an engaging portion that position the key-operation-force transfer mechanism in a neutral state corresponding to a neutral position of the key cylinder with respect to the housing.

4 Claims, 11 Drawing Sheets

DOOR LOCK APPARATUS

BACKGROUND OF THE INVENTION

1. Field of the Invention

The invention relates to a door lock apparatus mounted on a door of a vehicle.

2. Description of the Related Art

A door lock apparatus is provided on a door of a vehicle so that it is detachably engaged to a substantially U-shaped striker fixed to a vehicle body. The door lock apparatus includes a latch mechanism that is engaged to the striker, and a lock mechanism that releases the engagement of the striker by the latch mechanism.

In vehicles of recent years, at least the lock mechanism is accommodated in a closed housing, and a key cylinder into which a key is inserted is directly connected to the lock mechanism in the closed housing, thereby preventing fraudulent manipulation and theft of a vehicle.

As a door lock apparatus having such mechanisms, JP-A-2009-150114 describes a door lock apparatus in which a key lever that follows an operation of a key cylinder provided on an outer side of a door of a vehicle, and a key sub-lever connected to the key lever through a key link are provided so that a sector gear that interlocks with the key sub-lever moves to a lock position or an unlock position.

According to this door lock apparatus, the key sub-lever is connected to the sector gear with play so that the key sub-lever is not operated even if the sector gear is turned from the unlock position to the lock position and vice versa, for example by an actuator, when the key sub-lever is in a neutral position.

According to this door lock apparatus, however, the key sub-lever can turn within a range of the play with respect to the sector gear. Therefore, there is a problem that the key sub-lever, the key link and the key lever are not positioned, and the key lever is variable in position. If the key lever is variable in position, there is a problem that mutual connecting shapes of the key lever and the key cylinder including convex and concave portions do not match with each other when they are assembled together, and it is difficult to assemble them.

SUMMARY OF THE INVENTION

The invention has been accomplished in view of the conventional problems, and it is an object of the invention to provide a door lock apparatus capable of holding the key lever at a predetermined position by positioning the key link, and capable of facilitating an assembling workability between the key lever and the key cylinder.

To achieve the above object, a door lock apparatus of the invention includes: a latch mechanism for engaging with and disengaging from a striker; a lock mechanism having a link that can move to an unlock position where the latch mechanism can be operated and a lock position where the latch mechanism can not be operated, and a lock plate that moves the link to the unlock position and the lock position; a key-operation-force transfer mechanism that transfers an operation force of a key cylinder disposed on a door to the lock plate of the lock mechanism; and a housing in which at least the lock mechanism and the key-operation-force transfer mechanism are accommodated; wherein the door lock apparatus further comprises positioning means that positions the key-operation-force transfer mechanism in a neutral state corresponding to a neutral position of the key cylinder with respect to the housing.

By providing the positioning means, it is possible to position the key-operation-force transfer mechanism in its neutral state before the key cylinder is assembled into the key-operation-force transfer mechanism. According to this configuration, it is possible to easily assemble the key-operation-force transfer mechanism and the key cylinder, facilitating the assembling operation.

It is preferable that the positioning means includes a positioning portion that is provided in the housing and an engaging portion that is provided in the key-operation-force transfer mechanism and resiliently detachably engaged with the positioning portion.

Since the engaging portion of the key-operation-force transfer mechanism is resiliently detachably engaged with the positioning portion provided in the housing, the key-operation-force transfer mechanism can be operated in a state where the positioning means remains provided. Therefore, since it is unnecessary to detach the positioning means after the key cylinder is assembled, it is possible to further facilitate the assembling operation.

It is preferable that the key-operation-force transfer mechanism includes a key lever to which a rotation rod that projects from a rear end of the key cylinder is directly connected, the key lever turning in accordance with an operation of the key cylinder, a key link that is connected to the key lever and that reciprocates, and a key sub-lever that is connected to the key link and is turnably disposed in the housing, and that engages with the lock plate with play, wherein the engaging portion is provided on the key link.

The key link which reciprocates in a state where one end of the key link is connected to the key lever and the other end of the key link is connected to the key sub-lever is prone to rattle due to gaps for the connecting portions to move. By providing the key link with the positioning means, the key link is biased by a resilient force of the positioning means. Therefore, the rattle is suppressed, and it is possible to prevent an unusual sound from being generated by the rattle.

It is preferable that the housing is provided with a guide groove in which the key link is straightly guided, and an abutment wall that extends along the guide groove and with which the engaging portion slides, and the abutment wall is provided with the positioning portion.

According to this configuration, it is possible to configure the positioning means with a simple structure It is preferable that the engaging portion is integrally formed on the key link.

According to this configuration, independent or separate special parts are unnecessary, and the manufacturing cost can be reduced.

It is preferable that the key-operation-force transfer mechanism is further provided with a key-operation detection switch that detects an operation position of the key-operation-force transfer mechanism.

By providing the key-operation-force transfer mechanism that is positioned in the neutral state with the key-operation detection switch, it is possible to easily and reliably carry out a conduction test of the key-operation-force detection switch at the time of manufacture.

According to the door lock apparatus of the invention, the key-operation-force transfer mechanism can be positioned in the neutral state by the positioning means. According to this configuration, it is possible to easily assemble the key-operation-force transfer mechanism and the key cylinder, facilitating the assembling operation.

BRIEF DESCRIPTION OF THE DRAWINGS

FIG. 4 illustrate a latch mechanism of the door lock apparatus, wherein

DETAILED DESCRIPTION OF THE PREFERRED EMBODIMENTS

Embodiments of the invention will be described in accordance with the drawings.

Figure 1:
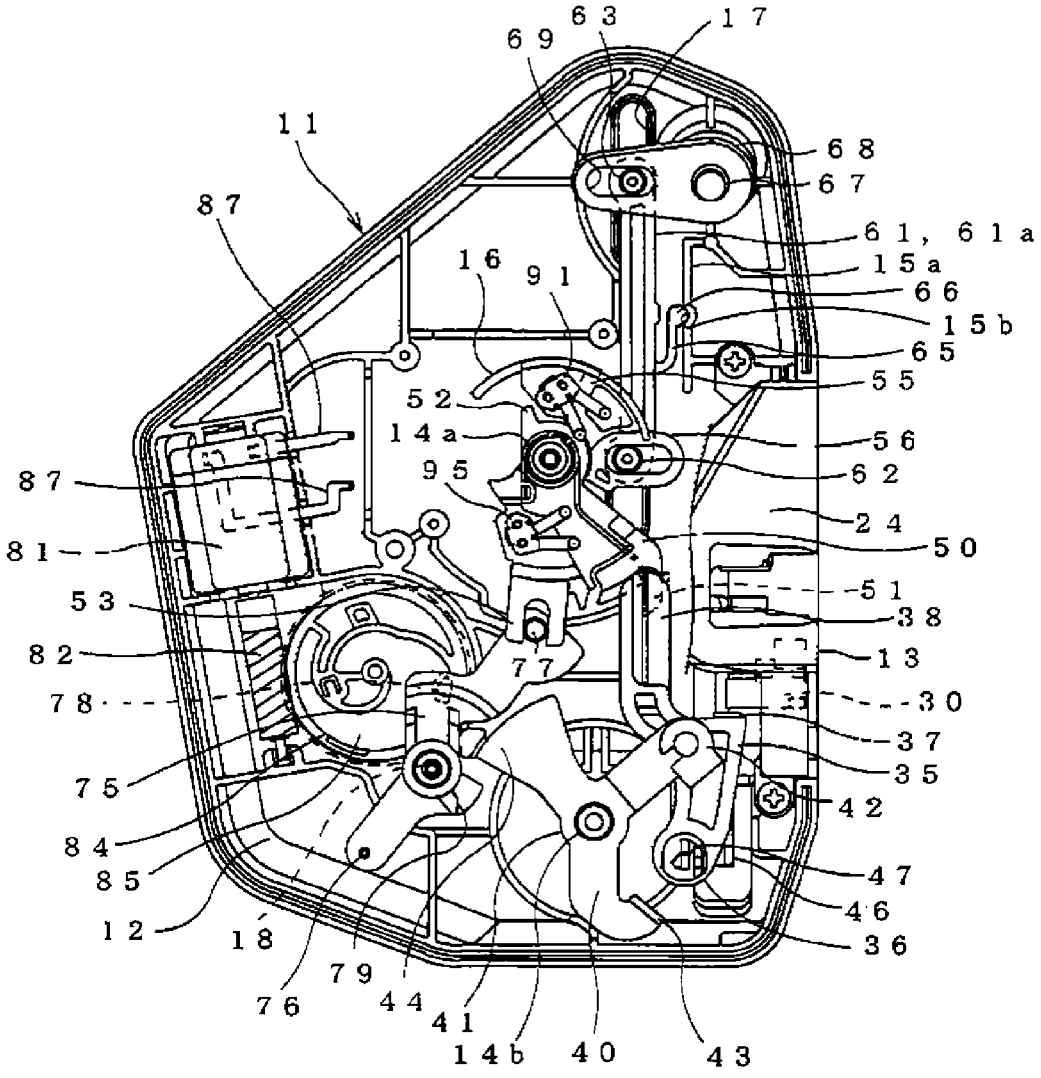
FIG. 1 is a front view illustrating a state where a door lock apparatus according to an embodiment of the invention is in an unlock state.
Figure 2:
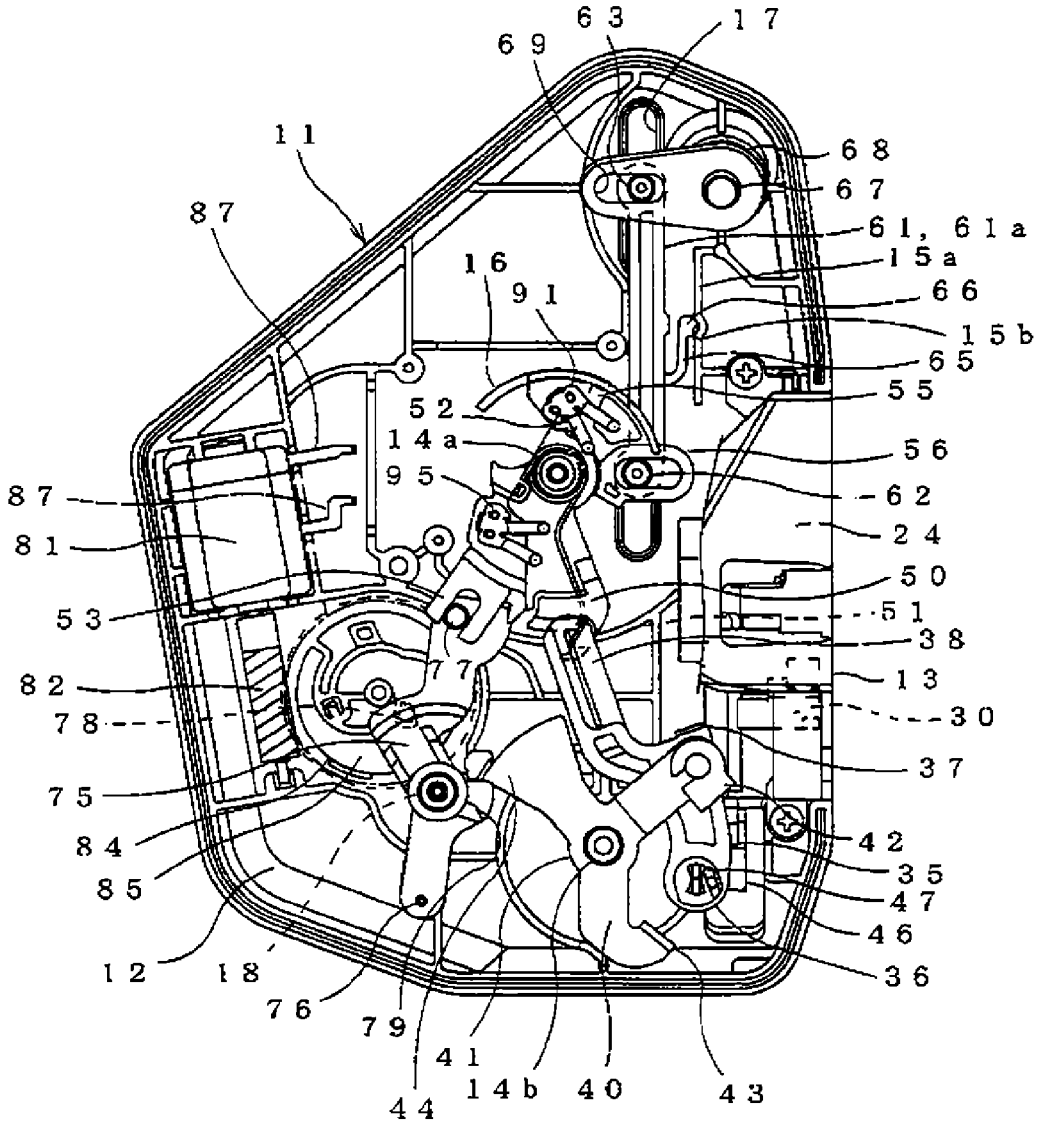
FIG. 2 is a front view illustrating a state where the door lock apparatus according to the embodiment of the invention is in a lock state.

FIGS. 1 and 2 illustrate a door lock apparatus according to an embodiment of the invention. The door lock apparatus is mounted on an openable and closable door of a vehicle so as to be detachably engaged to a striker 1 (see FIG. 4B) disposed on a vehicle body. The door lock apparatus is provided with a latch mechanism that is engaged to the striker 1, and a lock mechanism that locks and unlocks the engagement state of the striker 1 by the latch mechanism.

Figure 3A:
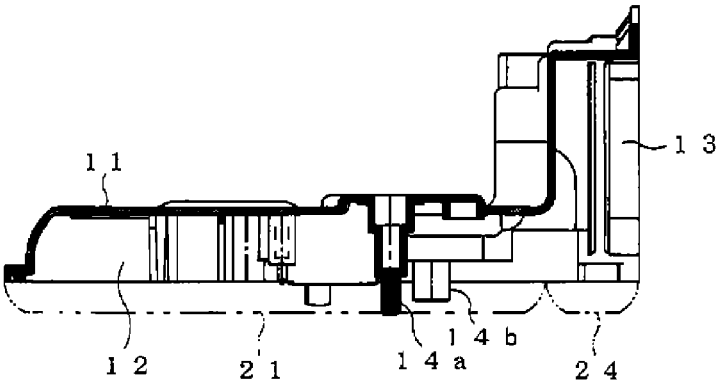
FIG. 3A is a sectional view taken along a line A-A in FIG. 3B.
Figure 3B:
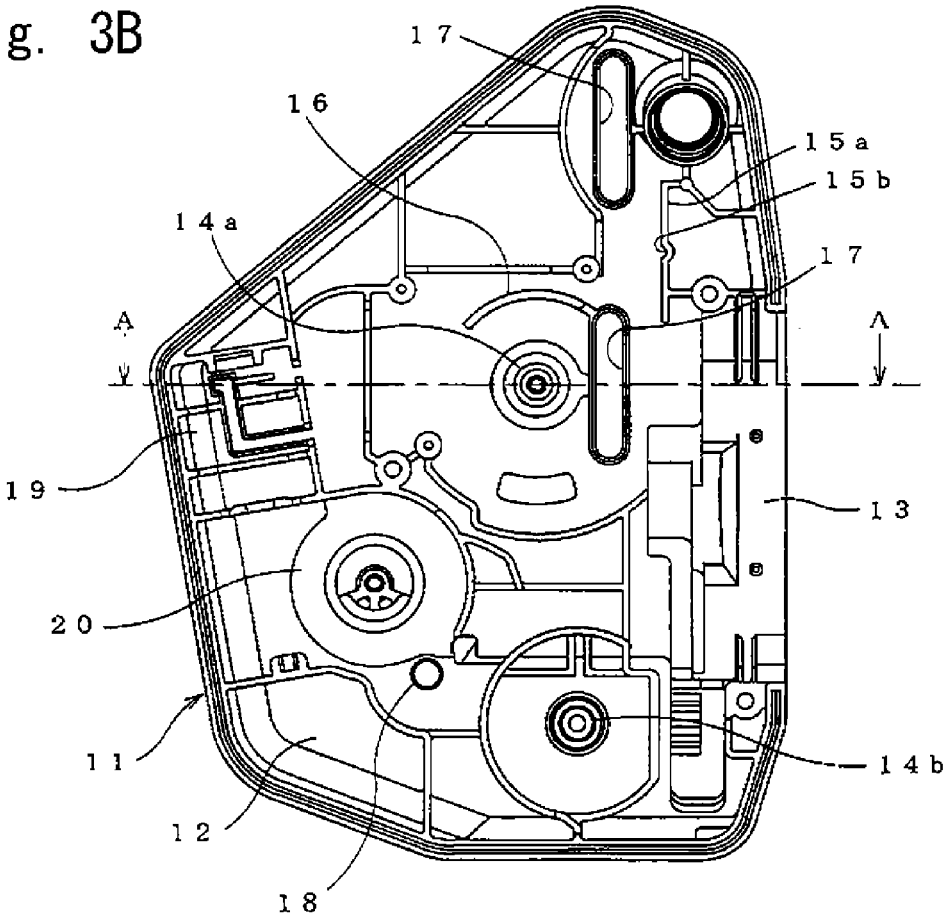
FIG. 3B is a front view illustrating a lock mechanism arranging-portion of a first case member illustrated in FIG. 1.

A first case member 11 in which various parts configuring the door lock apparatus are arranged is formed into an L-shape as viewed from above as illustrated in FIG. 3A, and includes a lock mechanism arranging-portion 12 and a latch mechanism arranging-portion 13. As illustrated in FIG. 3B, the lock mechanism arranging-portion 12 is provided with mounting shafts 14*a* and 14*b* that are support shafts for turnably supporting a lock plate 50 and an inner lever 40 which are described later. An upwardly curved arc-like support projecting portion 16 is provided on an upper side of the mounting shaft 14*a*. Two key link holding grooves (guide grooves) 17 are formed in a vertical direction on a right side of and diagonally above the mounting shaft 14*a*. The key link holding grooves 17 hold a later-described key link 61. On a right side of these key link holding grooves 17, an abutment wall 15*a* of the invention is provided toward the near side in the drawing. The abutment wall 15*a* extends in the vertical direction. A positioning concave portion (positioning portion) 15*b* that is curved in a direction opposite from the key link holding grooves 17 is provided at a central portion of the abutment wall 15*a*. A shaft hole 18 in which a later-described knob lever 75 is turnably disposed is provided on a left side of the mounting shaft 14*b*. A drive motor arranging-portion 19 and a cam member arranging-portion 20 are provided on a left side of and above the shaft hole 18. A second case member 21 mounted on the lock mechanism arranging-portion 12 of the first case member 11 configures a housing along with the first case member 11.

Figure 4A:
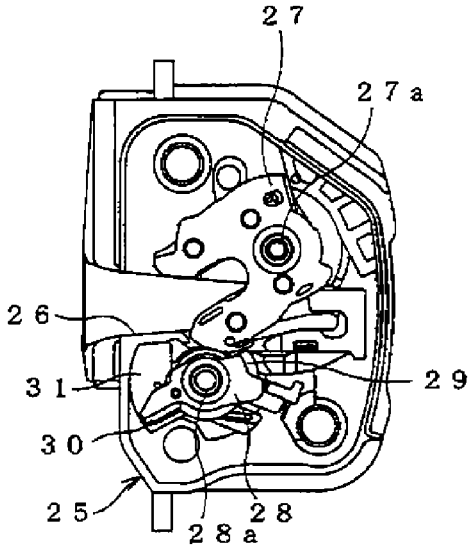
FIG. 4A is a side view illustrating a door-opened state.
Figure 4B:
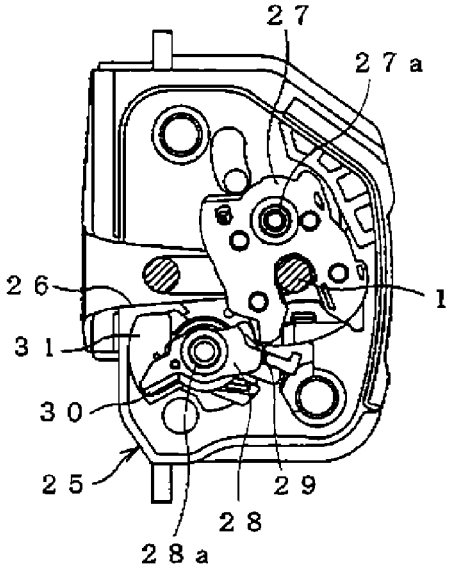
FIG. 4B is a side view illustrating a door-closed state.

A sub-case 24 mounted on the latch mechanism arranging-portion 13 of the first case member 11 covers the side of the fence block 25 of the latch mechanism disposed on the latch mechanism arranging-portion 13. As illustrated in FIGS. 4A and 4B, the fence block 25 is provided with an insertion recessed portion 26 so as to be recessed toward the latch mechanism arranging-portion 13. The insertion recessed portion 26 is a space through which the striker 1 is inserted. A fork 27 configuring the latch mechanism is turnably mounted on a mounting portion 27*a* above the insertion recessed portion 26. A claw 28 is turnably mounted on a mounting portion 28*a* below the insertion recessed portion 26. An insertion hole 31 through which an operation receiving portion 30 of the claw 28 is inserted to project into the latch mechanism arranging-portion 13 is formed on a left side of the mounting portion 28*a*.

The fork 27 of the latch mechanism detachably engages with the striker 1. The claw 28 engages with the fork 27 to hold a position in which the fork 27 engages with the striker 1. In the latch mechanism, the striker 1 presses the fork 27 due to a closing force of the door so that the fork 27 turns in a counterclockwise direction as illustrated from FIG. 4A to FIG. 4B. An engaging portion 29 of the claw 28 is engaged with the fork 27, and the engaged state of the striker 1 by the fork 27 is maintained. In this state, if the operation receiving portion 30 of the claw 28 is operated upward, the claw 28 is turned in a clockwise direction, and the engaged state between the fork 27 and the claw 28 is released. As a result, the fork 27 turns to an open position illustrated in FIG. 4A by a biasing force of a spring (not illustrated), and the engaged state of the striker 1 is released.

As illustrated in FIGS. 1 and 2, the lock mechanism that is assembled into the first case member 11 includes a link 35 that is engaged with the operation receiving portion 30 of the claw 28 to operate the claw 28 in its engagement-releasing direction, and the lock plate 50 that enables or disenables the operation of the claw 28 by the link 35.

A receiving portion 36 at the lower end of the link 35 receives an operation force of the inner lever 40 or an outer lever 46, allowing the link 35 to move upward. In the unlock position illustrated in FIG. 1, an operating portion 37 at a substantially central portion engages with the operation receiving portion 30 of the claw 28 to cause the claw 28 to operate in an engagement-releasing direction. Hence, the engaging state of the striker 1 by the latch mechanism can be released. A lock plate-connecting portion 38 at the upper portion of the link 35 is connected to the lock plate 50. The link 35 is moved to the unlock position and the lock position by turning motion of the lock plate 50. In the lock position illustrated in FIG. 2, the operating portion 37 is separated to a position where the operating portion 37 can not engage with the operation receiving portion 30 of the claw 28. Hence, even if the link 35 is moved upward by the outer lever 46 or the inner lever 40, the claw 28 can not be operated in the engagement-releasing direction. Therefore, the engaging state of the striker 1 by the latch mechanism can not be released.

The inner lever 40 is connected to an inner door handle (not illustrated) provided on the inner side of the door. The inner lever 40 is engaged with the receiving portion 36 of the link 35 to allow the link 35 to operate (slide) toward the releasing-operation receiving portion 30 of the claw 28. The inner lever 40 includes a mounting portion 41 that is turnably mounted on the mounting shaft 14*b* of the first case member 11. The inner lever 40 is provided with an inner handle connecting portion 42 that extends to project from an opening of the second case member 21 outward of the second case member 21. The inner handle connecting portion 42 is connected to the inner door handle. The inner lever 40 is provided with a substantially J-shaped link operating portion 43. The receiving portion 36 of the link 35 is located on a rotation locus of the link operating portion 43 around the mounting portion 41 in the assembled state. The inner lever 40 is further provided with an engaging portion 44 that engages with an engagement-receiving portion 79 of the knob lever 75 to move the link 35 to the unlock position through the knob lever 75 and the lock plate 50 in a state where the knob lever 75 is located at the lock position.

Figure 5:
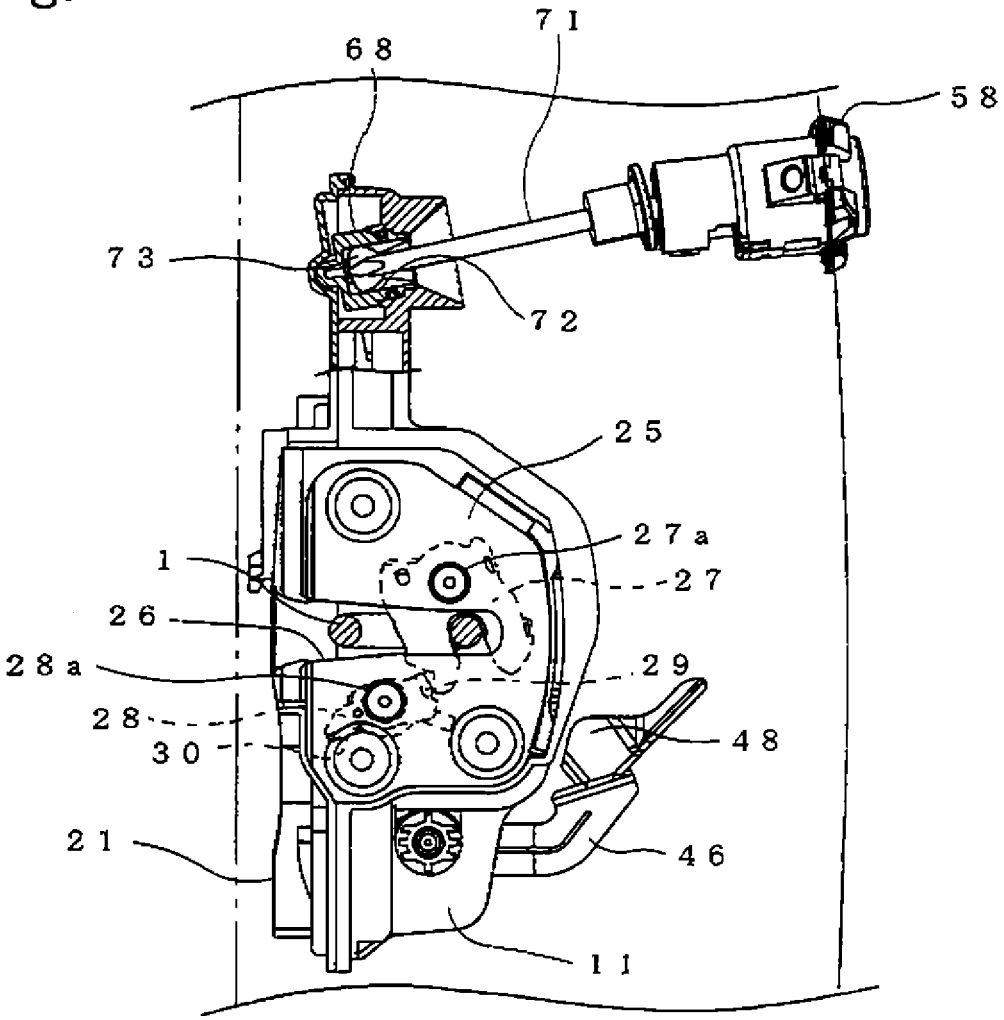
FIG. 5 is a side view illustrating a relationship between the latch mechanism and a key cylinder illustrated in FIG. 4.

As illustrated in FIG. 5, the outer lever 46 passes through the first case member 11 and extends inward and outward, and the outer lever 46 is turnably mounted on the first case member 11. The outer lever 46 is provided with an outer handle connecting portion 48 at a portion projecting from the first case member 11 to outside. The outer handle connecting portion 48 is connected to an outer handle (not illustrated) provided on the door on the outer side of the vehicle. If the outer handle is operated, a link connecting portion 47 positioned at a tip end and connected to an interior of the receiving portion 36 moves upward, causing the link 35 to move upward.

Figure 6:
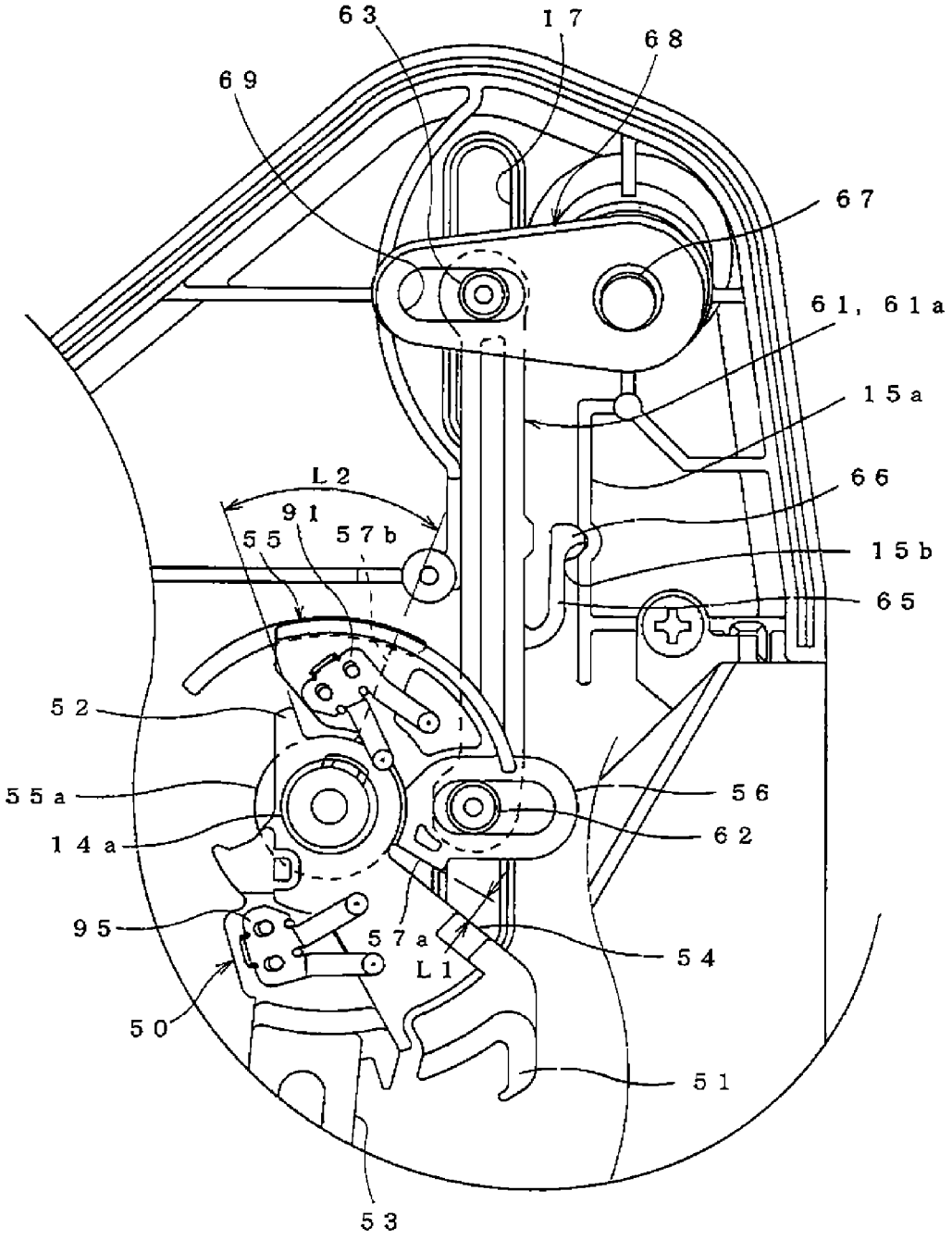
FIG. 6 is a partially enlarged front view of a key-operation-force transfer mechanism illustrated in FIG. 1.
Figure 7A:
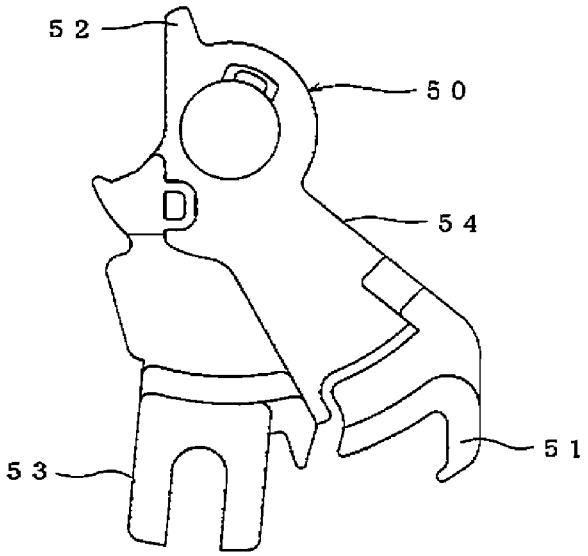
FIG. 7A is an enlarged front view of a lock plate illustrated in FIG. 1.

As illustrated in FIG. 6, the lock plate 50 is turnably mounted on the mounting shaft 14*a* of the first case member 11. If the lock plate 50 is turned by a later-described key sub-lever 55 or the knob lever 75 in the clockwise direction, a link engaging portion 51 (see FIG. 7A) provided on a lower end of the lock plate 50 moves leftward, thereby moving the link 35 from the unlock position to the lock position. If the lock plate 50 is turned in the counterclockwise direction, the link engaging portion 51 moves rightward, thereby moving the link 35 from the lock position to the unlock position. The lock plate 50 is provided with an unlock-operation receiving portion 52 that receives an unlock operation of the key sub-lever 55 and a right edge 54 that receives a lock operation of the key sub-lever 55. A knob lever engaging portion 53 that receives an unlock operation and a lock operation of the knob lever 75 is provided on the opposite side of the link engaging portion 51.

A second movable contact 95 configuring a lock state-detection switch is disposed on an upper surface of the lock plate 50 on the side of the knob lever engaging portion 53. The lock state-detection switch detects the lock state or the unlock state of the door by detecting a moving position of the lock plate 50.

Figure 7B:
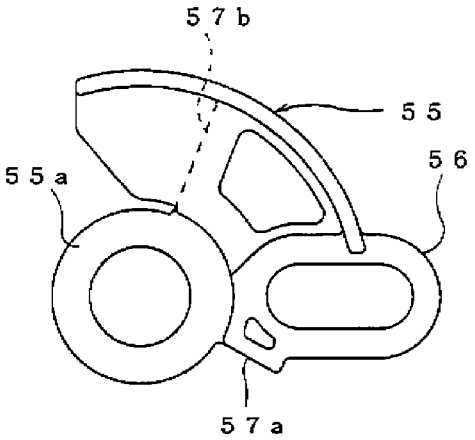
FIG. 7B is an enlarged front view of a key sub-lever illustrated in FIG. 1.

The key sub-lever 55 is turnably mounted on the mounting shaft 14*a* of the first case member 11 together with the lock plate 50. As illustrated in FIG. 7B, the key sub-lever 55 has a substantially sector shape having an annular mounting portion 55*a* as an apex. The annular mounting portion 55*a* is fitted over the mounting shaft 14*a*. The key sub-lever 55 includes a first engaging portion 57*a* provided on one of edges of the key sub-lever 55, a second engaging portion 57*b* that is located on the side of the other edge and that projects from a back surface of the key sub-lever 55 toward a deep side in the drawing, and a connecting portion 56 that is provided between the first engaging portion 57*a* and the second engaging portion 57*b* and that has an elliptic insertion hole. By turning the key sub-lever 55 in the clockwise direction, the first engaging portion 57*a* abuts against the right edge 54 of the lock plate 50 to transfer a lock operation toward the lock plate 50. By turning the key sub-lever 55 in the counterclockwise direction, the second engaging portion 57*b* abuts against the unlock-operation receiving portion 52 of the lock plate 50 to transfer an unlock operation to the lock plate 50. The connecting portion 56 is fitted over a later-described lower circular projection 62 of the key link 61.

The key sub-lever 55 is mounted with play with respect to the lock plate 50 so that the key sub-lever 55 is not operated even if the lock plate 50 turns. More specifically, a distance L1 is provided as play between the first engaging portion 57*a* and the right edge 54 of the lock plate 50. Further, a distance L2 is provided between the second engaging portion 57*b* and the unlock-operation receiving portion 52 of the lock plate 50.

A first movable contact 91 configuring the key-operation detection switch is disposed on the key sub-lever 55. The key-operation detection switch detects that the unlock operation or lock operation of the key cylinder 58 is carried out through the key link 61, the key lever 68 and a rotation rod 71 by detecting a moving position of the key sub-lever 55. The key-operation detection switch includes the first movable contact 91 and a fixed contact 93 (see FIG. 9) disposed on a later-described switch board 101.

Figure 7C:
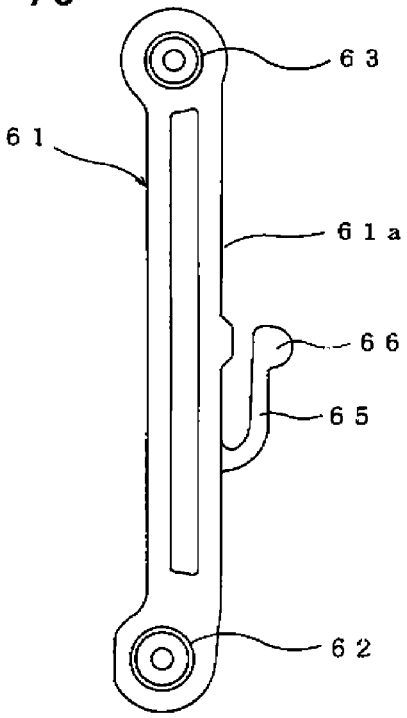
FIG. 7C is an enlarged front view of a key link illustrated in FIG. 1.

As illustrated in FIG. 7C, the key link 61 includes a rod-like key link body 61*a* extending in the vertical direction, an upper circular projection 63 that is provided on an upper end of the key link body 61 a and that projects in both forward and rearward directions (on the near side and deep side in the sheet of the drawing), and the lower circular projection 62 that is provided on a lower end of the key link body 61*a* and that projects in both forward and rearward directions. The upper circular projection 63 and the lower circular projection 62 are guided by the respective key link holding grooves 17 so that the key link 61 is held so as to straightly (linearly) reciprocate in the vertical direction with respect to the first case member 11. The key link body 61*a* of the invention is integrally provided with an arm 65 that projects from a side edge of the key link body 61*a* and that extends in parallel to the abutment wall 15*a* of the first case member 11 along the key link body 61*a*, and an engaging portion 66 that projects from an end of the arm 65 toward the abutment wall 15*a*. The arm 65 resiliently biases the engaging portion 66 toward the abutment wall 15*a*. When the engaging portion 66 and the positioning concave portion 15*b* are fitted to each other, the key link 61 is positioned and the key lever 68 is held in its neutral state. The engaging portion 66 and the positioning concave portion 15*b* configure a positioning mechanism.

Figure 8A:
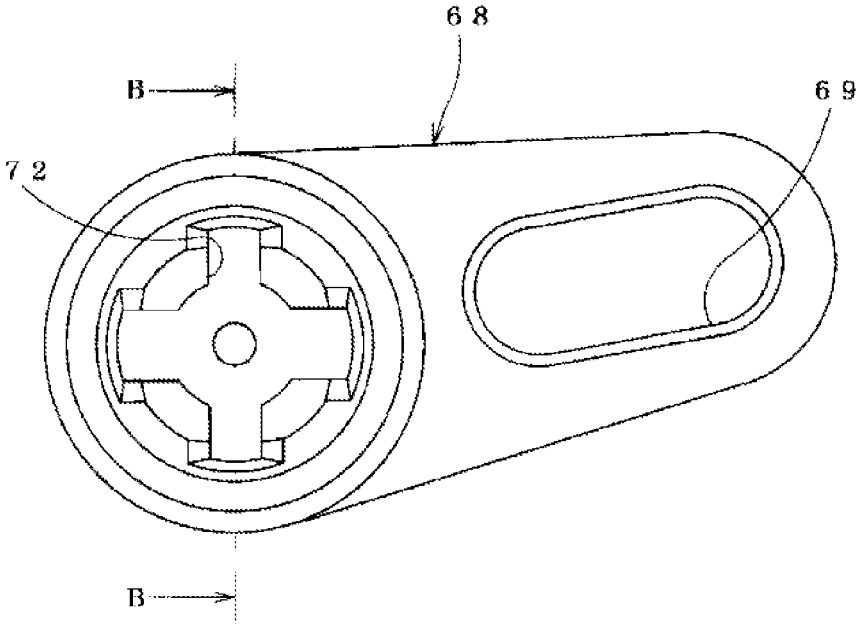
FIG. 8A is a rear view of a key lever.
Figure 8B:
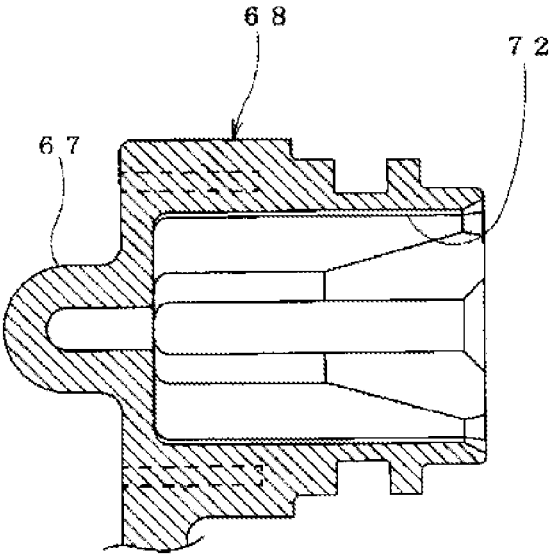
FIG. 8B is a sectional view taken along a line B-B in FIG. 8A.
Figure 8C:
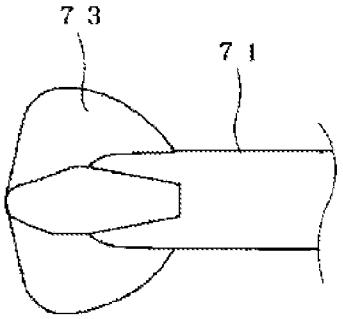
FIG. 8C is a partially enlarged side view of a tip end of a rotation rod illustrated in FIG. 5.

The key lever 68 follows the key cylinder 58 (see FIG. 5) which is disposed so as to be exposed to the outside of the door and turns around a shaft 67 in the clockwise direction or counterclockwise direction. The key lever 68 includes the shaft 67 provided on one side, an oblong insertion hole 69 provided on the opposite side of the shaft 67, and a connection concave portion 72 provided on a back side of the shaft 67 illustrated in FIGS. 8A and 8B. The upper circular projection 63 of the key link 61 is fitted into the long insertion hole 69. The connection concave portion 72 has a cross shape as viewed from front. A connection end 73 (see FIG. 8C) having a cross shape as viewed from front is formed on a tip end of the rotation rod 71. The connection end 73 is fitted into the connection concave portion 72. The rotation rod 71 is connected to the key cylinder 58 and integrally rotates together with turning motion of a key (not illustrated) inserted into the key cylinder 58.

According to the above configuration, by turning the key inserted into the key cylinder 58, the key lever 68 is turned together with the rotation rod 71. The key link 61 follows the key lever 68 and moves in the vertical direction, and the key sub-lever 55 turns in the clockwise direction or counterclockwise direction from its neutral state. The key sub-lever 55, the key link 61 and the key lever 68 configure a key-operation-force transfer mechanism.

The knob lever 75 is turnably supported in the shaft hole 18 of the first case member 11. A knob lever-side connecting portion 76 formed on one end of the knob lever 75 is connected to a lock knob (not illustrated) provided on the inner side of the door through an opening of the second case member 21. A lock plate engaging portion 77 is provided on the other end of the knob lever 75. The lock plate engaging portion 77 is engaged with the knob lever engaging portion 53 of the lock plate 50. When the knob lever 75 is turned in association with operation of the lock knob, the lock plate 50 is operated to move the link 35 to the lock position or the unlock position. More specifically, when the knob lever 75 is turned in the counterclockwise direction by the lock knob, the lock plate engaging portion 77 turns the lock plate 50 to the lock position. When the knob lever 75 is turned in the clockwise direction by the lock knob, the lock plate engaging portion 77 turns the lock plate 50 to the unlock position. A cam receiving portion 78 that engages with a cam groove 85 of a cam member 84 located on a back portion is provided above the shaft hole 18. The knob lever 75 is provided with the engagement-receiving portion 79 that receives turning motion of the inner lever 40 only in a state where the knob lever 75 moves to the lock position.

A drive motor 81 that is adjacent to the cam member 84 is powered from a later-described connector 104 (see FIG. 9) through a motor terminal 87. The motor terminal 87 is directly connected to an interior of the connector 104. The drive motor 81 normally or reversely rotates the cam member 84 through an output shaft 82. The cam member 84 is rotatably disposed such that it is opposed to the cam receiving portion 78 of the knob lever 75. A cam groove 85 is recessed in an upper surface of the cam member 84 that is opposed to the knob lever 75 such that a distance between a center and an outer periphery of the cam groove 85 is gradually increased. When the cam member 84 is rotated such that the cam receiving portion 78 moves toward the center, the link 35 is operated to the lock position through the knob lever 75 and the lock plate 50. When the cam member 84 is rotated such that the cam receiving portion 78 moves toward the outer periphery on the other hand, the link 35 is operated to the unlock position through the knob lever 75 and the lock plate 50.

Figure 9:
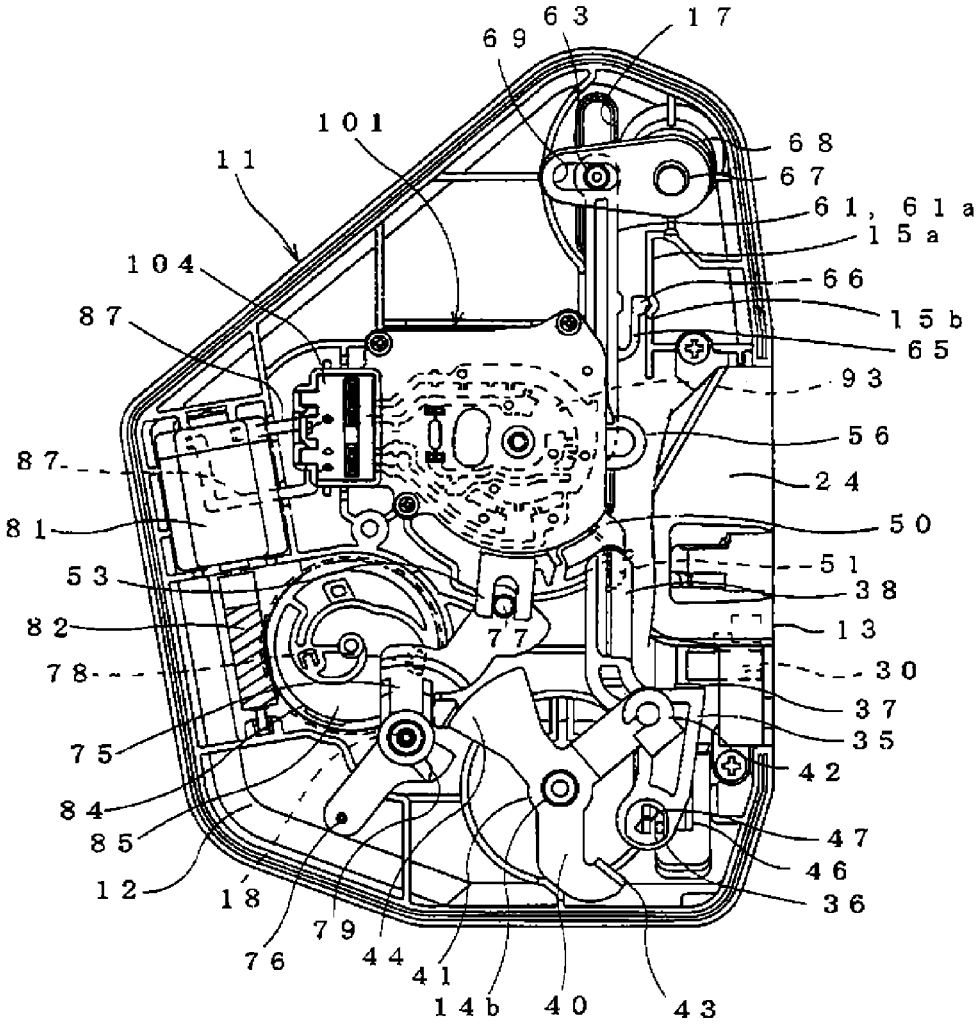
FIG. 9 is a front view illustrating a state where a switch board is put on the first case member illustrated in FIG. 1.

As illustrated in FIG. 9, the switch board 101 is threadedly secured to the first case member 11 such that the switch board 101 covers the lock plate 50 and the key sub-lever 55 and opposes to the first movable contact 91 and the second movable contact 95. The fixed contact 93 is laid on a surface of the switch board 101 that is opposed to the movable contacts 91 and 95. The fixed contact 93 includes a pattern piece with which the movable contacts 91 and 95 slide in a short circuit state An external ECU (not illustrated) is connected to the fixed contact 93 through the connector 104. The external ECU can detects the operation of the key cylinder 58, and the lock state and the unlock state of the door lock apparatus by detecting that a conductive state of the fixed contact 93 is switched by the movements of the movable contacts 91 and 95.

Next, assembling of the key cylinder 58 into the key lever 68 that is mounted on the first case member 11 will be described.

To assemble the key cylinder 58 into the key lever 68, the connection end 73 of the rotation rod 71 connected to the key cylinder 58 is fitted into the connection concave portion 72 of the key lever 68. At that time, since the connection end 73 and the connection concave portion 72 have the cross shapes, it is necessary to hold the key lever 68 in its neutral state corresponding to the neutral position of the key cylinder 58. However, the key sub-lever 55 is disposed with play with respect to the lock plate 50 as described above. Therefore, it has been difficult to hold, in the neutral state, the key lever 68 that is connected to the key sub-lever 55 through the key link 61.

In this embodiment, however, it is possible to position the key link 61 and to hold the key lever 68 in the neutral state by engaging the positioning concave portion 15*b* and the engaging portion 66 with each other. Therefore, it is possible to facilitate the fitting operation between the connection concave portion 72 and the connection end 73, and easily assemble the key cylinder 58 into the key lever 68, facilitating the assembling operation.

Since the engaging portion 66 of the key link 61 is detachably resiliently engaged with the positioning concave portion 15*b*, the key link 61 can be operated in a state where the engaging portion 66 remains provided. Therefore, since it is unnecessary to detach the arm 65 and the engaging portion 66 after the key link 61 is assembled, further facilitating the assembling operation.

The key link 61 which reciprocates in a state where one end of the key link 61 is connected to the key lever 68 and the other end of the key link 61 is connected to the key sub-lever 55 is prone to rattle due to gaps for various connecting portions to move. However, by providing the key link 61 with the arm 65 and the engaging portion 66, the engaging portion 66 and the positioning concave portion 15*b* engage with each other, and the key link 61 is biased by a resilient force of the arm 65. Therefore, it is possible to suppress the rattle of the key link 61, preventing an unusual sound from being generated by the rattle.

The positioning means includes the positioning concave portion 15*b* formed in the abutment wall 15*a* of the first case member 11 and the engaging portion 66 that is integrally provided on the key link 61. Therefore, it is possible to provide the positioning means by the simple configuration.

Since the arm 65 and the engaging portion 66 are integrally formed on the key link 61, independent or separate special parts become unnecessary, reducing manufacturing cost.

Since the key sub-lever 55 that is positioned in its neutral state by the key link 61 is provided with the key-operation detection switch, it is possible to reliably hold the key sub-lever 55 in the neutral position, enabling to easily carry out a conduction test of the key-operation-force detection switch at the time of manufacture.

The lock operation and the unlock operation of the door lock apparatus that are carried out by the key cylinder 58 will be described below.

Figure 10:
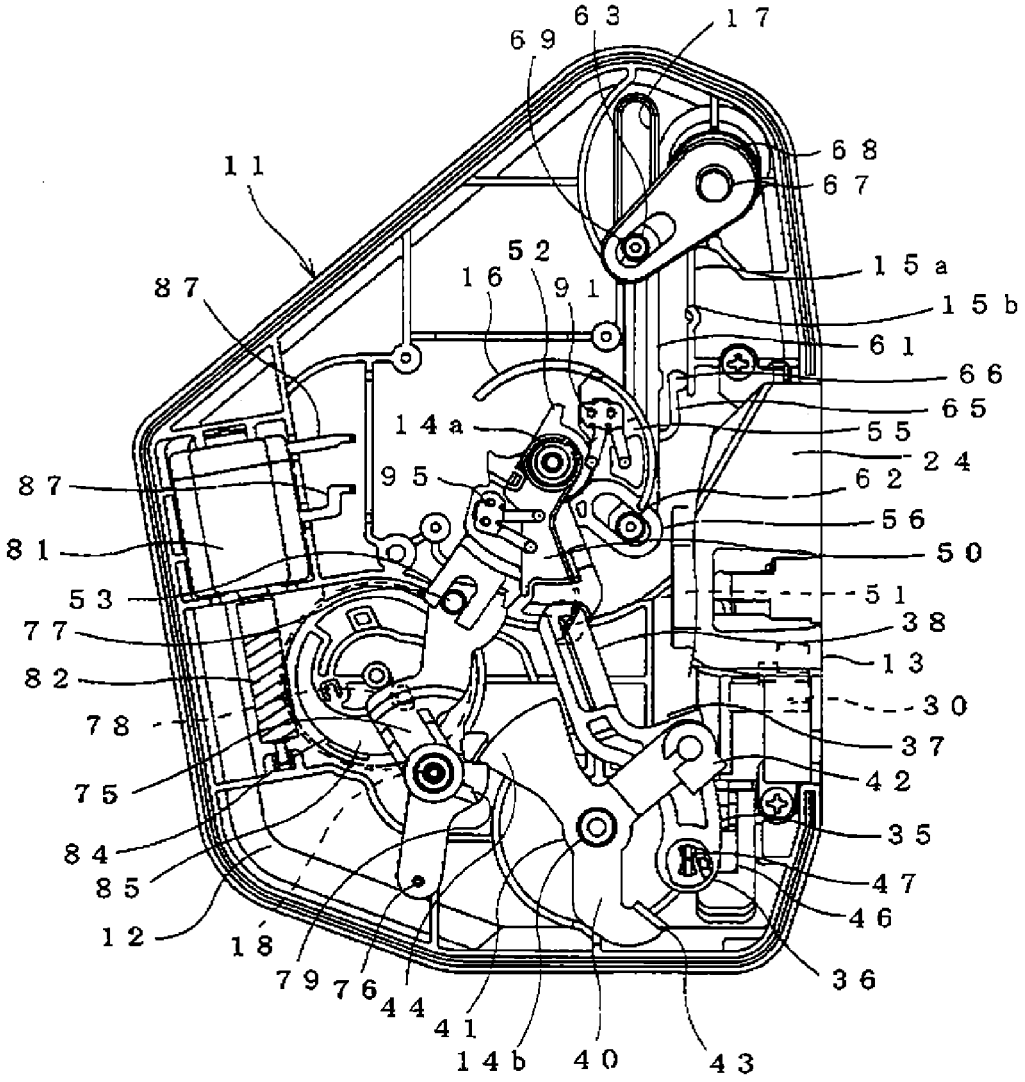
FIG. 10 is a front view illustrating a state where a lock operation of the key cylinder is carried out from the unlock state shown in FIG. 1.

In an unlock state illustrated in FIG. 1, if the key cylinder 58 located outside of the vehicle is operated in a lock direction, as illustrated in FIG. 10, the key lever 68 of the lock mechanism turns in the counterclockwise direction in FIG. 10 around the shaft 67 from the neutral state. Then, the engagement between the engaging portion 66 of the key link 61 and the concave portion 15*b* is released, and the key link 61 moves downward as the engaging portion 66 slides with the abutment wall 15*a*. According to this movement, the key sub-lever 55 turns in the clockwise direction, the lock plate 50 also turns in the clockwise direction, thereby moving the link 35 to the lock position. Thereafter, if the key cylinder 58 is returned to the neutral position and the key is pulled out from the key cylinder 58, the key lever 68 turns in the clockwise direction, the key link 61 moves upward and the key sub-lever 55 turns in the counterclockwise direction. According to this operation, the key lever 68, the key link 61 and the key sub-lever 55 return to their neutral positions, and the engaging portion 66 of the key link 61 and the concave portion 15*b* are again brought into the engaged state (state illustrated in FIG. 2).

Figure 11:
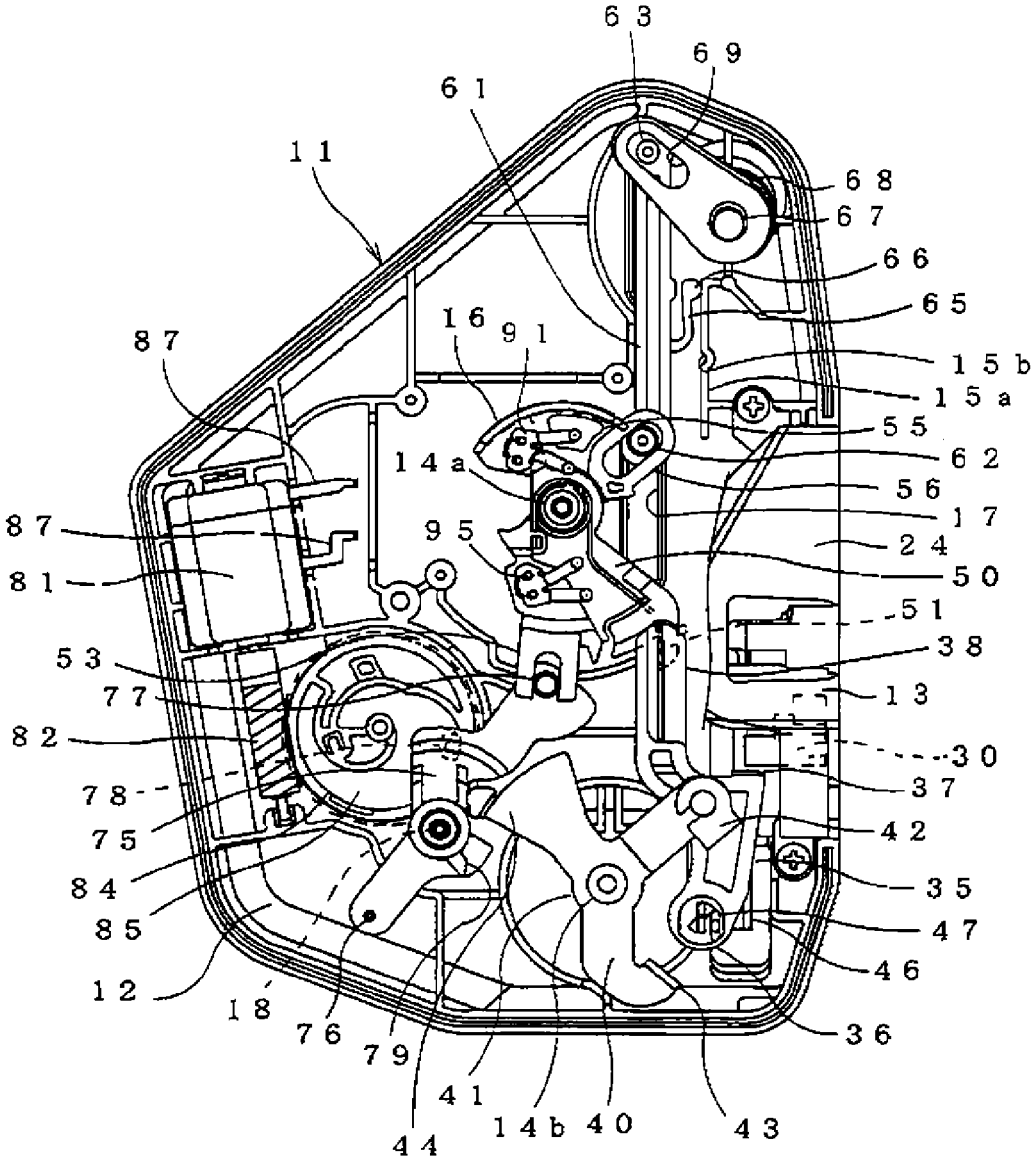
FIG. 11 is a front view illustrating a state where an unlock operation of the key cylinder is carried out from the lock state shown in FIG. 2.

In the lock state illustrated in FIG. 2, if the key cylinder 58 located outside of the vehicle is operated in the unlock direction, as illustrated in FIG. 11, the key lever 68 of the lock mechanism turns from the neutral state in the clockwise direction in FIG. 11 around the shaft 67. According to this movement, the engagement between the engaging portion 66 of the key link 61 and the concave portion 15*b* is released, and the key link 61 moves upward as the engaging portion 66 slides with the abutment wall 15*a*. According to this movement, the key sub-lever 55 turns in the counterclockwise direction, the lock plate 50 also turns in the counterclockwise direction, thereby moving the link 35 to the unlock position. Thereafter, if the key cylinder 58 is returned to the neutral position and the key is pulled out from the key cylinder 58, the key lever 68 turns in the counterclockwise direction, the key link 61 moves downward, and the key sub-lever 55 turns in the clockwise direction. According to this operation, the key lever 68, the key link 61 and the key sub-lever 55 returns to their neutral positions, and the engaging portion 66 of the key link 61 and the concave portion 15*b* are again brought into the engaged state (state illustrated in FIG. 1).

The door lock apparatus of the invention is not limited to the embodiment and can variously be modified.

Shapes and sizes of the arm 65 and the engaging portion 66 are not limited only if the engaging portion 66 engages with the positioning concave portion 15*b* to position the key link 61 and the engaging portion 66 slides with the abutment wall 15*a*.

Shapes and sizes of the abutment wall 15*a* and the positioning concave portion 15*b* are not limited only if the key link 61 is positioned through the engaging portion 66.

What is claimed is:

1. A door lock apparatus comprising:

a latch mechanism for engaging with and disengaging from a striker;

a lock mechanism including:

a link movable between an unlock position where the latch mechanism can be operated and a lock position where the latch mechanism cannot be operated; and a lock plate configured to move the link to the unlock position and the lock position;

a key-operation-force transfer mechanism configured to transfer an operation force of a key cylinder disposed on a door to the lock plate of the lock mechanism, the key-operation-force transfer mechanism including:

a key lever to which a rotation rod projecting from a rear end of the key cylinder is directly connected, the key lever configured to turn in accordance with an operation of the key cylinder;

a key link connected to the key lever and configured to reciprocate; and a key sub-lever connected to the key link and engaging with the lock plate with play;

a housing in which at least the lock mechanism and the key-operation-force transfer mechanism are accommodated, the key sub-lever being turnably disposed in the housing; and a positioning mechanism configured to position the key-operation-force transfer mechanism in a neutral state corresponding to a neutral position of the key cylinder with respect to the housing, the positioning mechanism including:

a positioning portion in the housing; and an engaging portion on the key link and resiliently detachably engaged with the positioning portion;

wherein the housing has:

a guide groove, the key link being linearly guided in the guide groove; and an abutment wall extending parallel to the guide groove and with which the engaging portion slides, the abutment wall having the positioning portion thereon.

2. The door lock apparatus according to claim 1, wherein the engaging portion is integrally formed on the key link.

3. The door lock apparatus according to claim 1, wherein the key-operation-force transfer mechanism further includes a key-operation detection switch configured to detect an operation position of the key-operation-force transfer mechanism.

4. The door lock apparatus according to claim 1, wherein the guide groove is an elongated linear groove for guiding a reciprocating linear movement of the key link.

* * * * *